United States Patent [19]

Kuhlenschmidt et al.

[11] 3,962,088

[45] June 8, 1976

[54] CONCRETE BLOCK ASSEMBLY

[75] Inventors: Harold L. Kuhlenschmidt; Floyd E. Kuhlenschmidt, both of Elberfeld, Ind.

[73] Assignee: Elberfeld Concrete Block Co., Inc. (Entire), Elberfeld, Ind.

[22] Filed: Sept. 17, 1974

[21] Appl. No.: 506,897

[52] U.S. Cl. ..... 210/170; 52/227; 61/11; 210/532 S

[51] Int. Cl.[2] ..... E02B 11/00; C02B 3/06

[58] Field of Search ..... 52/227; 61/10–13; 210/2, 14, 15, 16, 50, 52, 170, 199, 532 S, 293

[56] References Cited

UNITED STATES PATENTS

| | | | |
|---|---|---|---|
| 1,214,442 | 1/1917 | Edlin | 52/227 X |
| 1,306,962 | 6/1919 | Jagdmann | 52/227 |
| 2,087,958 | 7/1937 | Allen | 52/227 |
| 2,716,864 | 9/1955 | Hacker | 52/227 X |
| 2,921,354 | 1/1960 | Pankey et al. | 52/227 X |
| 3,422,010 | 1/1969 | Case | 210/532 S |
| 3,430,397 | 3/1969 | Ellis | 52/227 |

*Primary Examiner*—Charles N. Hart
*Assistant Examiner*—Robert H. Spitzer
*Attorney, Agent, or Firm*—Clarence A. O'Brien; Harvey B. Jacobson

[57] ABSTRACT

A concrete block assembly for use in a septic tank sewage disposal system including a plurality of porous blocks each having multiple apertures therethrough oriented in end-to-end, sealed relationship and retained in this relationship by tension rods extending through the assembly to form a module which can be assembled at a factory site, transported to the site of installation and lowered into a trench or ditch to form part of the drain field of a septic tank disposal system. Connecting assemblies are provided for assembling a plurality of block modules in end-to-end communicating relationship to provide adequate capacity for each installation.

2 Claims, 6 Drawing Figures

CONCRETE BLOCK ASSEMBLY

BACKGROUND OF THE INVENTION

1. Field of the Invention

The present invention generally relates to septic tank sewage disposal systems and more particularly the drain field by which an effluent is disposed of below ground surface in a well known manner with the invention more particularly relating to an assembly of porous concrete blocks having tension rods extending through and connecting a group of blocks into a module to facilitate assembly and installation of the septic tank disposal system.

2. Description of the Prior Art

Septic tank sewage disposal systems basically include a septic tank and a drain field which includes a series of trenches or ditches dug into the soil at a predetermined depth, a quantity of gravel, sand or the like in the bottom of the trenches and drain tile disposed therein and communicated with the septic tank. The drain tiles are, in some instances, spaced apart slightly to form discharge slots for liquid effluent so that such effluent will discharge into the soil surface. One of the problems which occurs in this type of installation is the incapability of the soil to absorb effluent and clogging of the drain field by solid organic material. Most localities require that the soil pass a percolation test before a septic tank sewage disposal system can be installed.

Efforts have been made to improve such systems with U.S. Pat. No. 3,422,010 issued Jan. 14, 1969, disclosing a different type of arrangement in which a plurality of concrete blocks of porous material are assembled in sealed end-to-end relation by use of mortar with each of the blocks including multiple passageways therein which, when aligned, provide a drain field in which effluent is discharged through the blocks throughout the length of the drain field and throughout the periphery of the blocks due to the multiple passageways therethrough in which the effluent will pass back and forth through the aligned blocks.

When installing this type of system, it is difficult to apply mortar to the ends of the blocks and orient the blocks in end-to-end aligned relation when at the bottom of a relatively narrow trench. In addition to being quite time consuming, the installation requires considerable expertise and requires substantial manual handling and manipulation of the blocks, all of which render the installation of this type of block relatively inefficient and quite costly.

SUMMARY OF THE INVENTION

An object of the present invention is to provide a concrete block assembly for use in a septic tank drain field in which the concrete blocks are porous and provided with four relatively large openings extending therethrough and tension members extending through a plurality of blocks for maintaining them in assembled, end-to-end, aligned condition with a mastic type cement between adjacent blocks so that the blocks may be assembled into a module at a factory site, transported to the installation site and lowered into the drain field trench at the installation site thereby materially reducing the time and labor in installing a drain field and providing a drain field which is less subject to breakage or misalignment due to shifting soil, heavy traffic loads and the like.

Another object of the invention is to provide a concrete block assembly in accordance with the preceding object in which the modules or assemblies may be interconnected in end-to-end relationship by specially constructed clips and bolts to enable the modules to be easily assembled in the drain field ditch or trench so that the overall length and capacity of the drain field may be varied to meet the requirements of each installation.

These together with other objects and advantages which will become subsequently apparent reside in the details of construction and operation as more fully hereinafter described and claimed, reference being had to the accompanying drawings forming a part hereof, wherein like numerals refer to like parts throughout.

FIG, 4 is a side elevational view of the end portions of two connected assemblies or modules.

Figure 1:
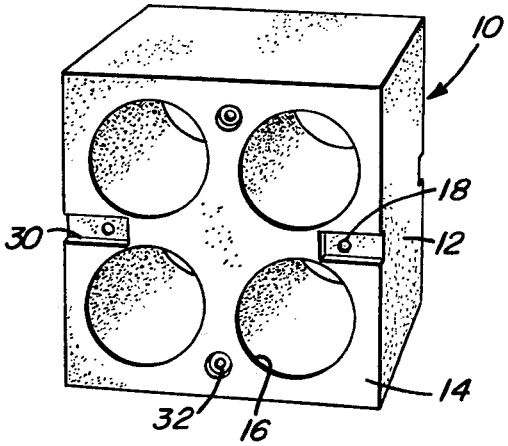
FIG. 1 is a perspective view of one of the porous concrete blocks.
Figure 4:
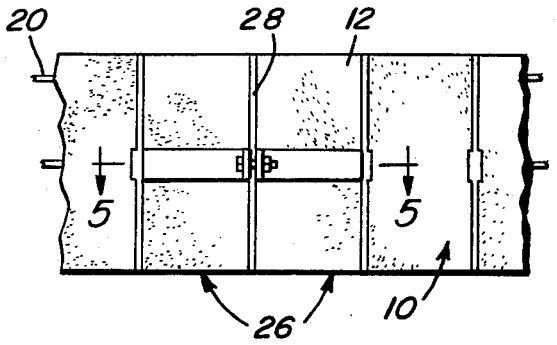
Figure 5:
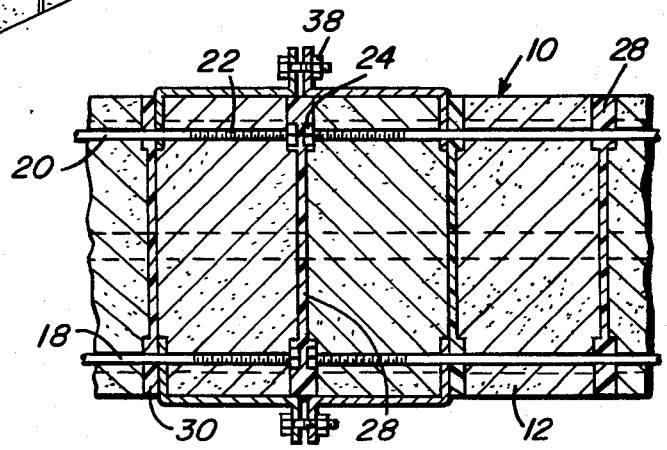

FIG. 5 is a longitudinal, vertical sectional view taken substantially upon a plane passing along section line 5—5 of FIG. 4 illustrating the specific structural details of the connecting clips between adjacent assemblies or modules.

Figure 6:
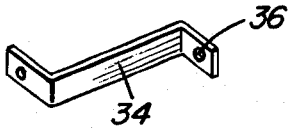
Figure 3:
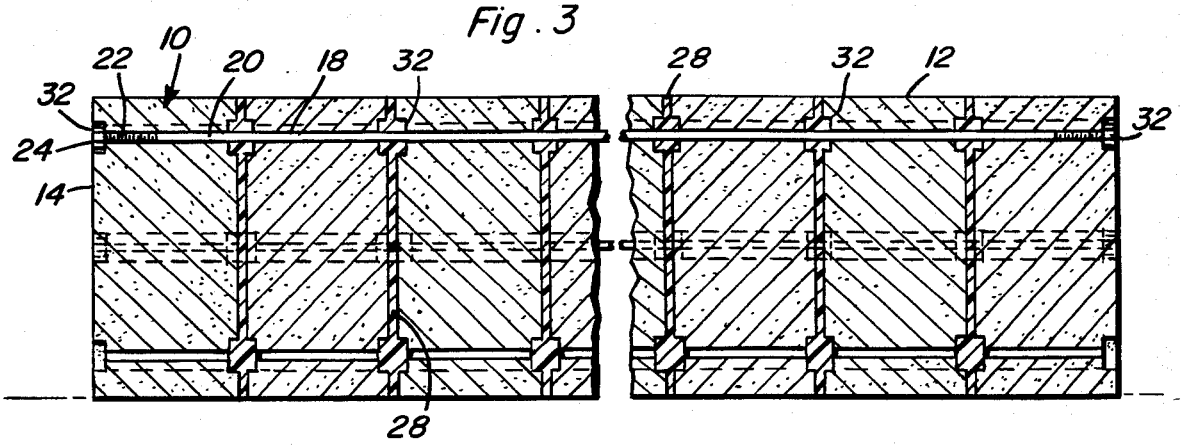
FIG. 3 is a longitudinal, vertical sectional view taken substantially upon a plane passing along section line 3—3 of FIG. 2 illustrating the structure of the tension rods and their relationship to the blocks.

FIG. 6 is a perspective view of one of the connecting clips.

DESCRIPTION OF THE PREFERRED EMBODIMENT

The porous concrete blocks 10 are constructed in a manner quite similar to that illustrated in U.S. Pat. No. 3,422,010, and includes flat side walls 12 defining a generally square block having planar end walls 14 which are interconnected by four relatively large openings 16 extending therethrough. The blocks 10 are assembled in end-to-end relation and at the end of each drain line or drain bed in the drain field, connecting elbows or end blocks with connecting passageways are employed so that effluent will pass longitudinally in one of the passageways formed by the aligned openings 16 until it reaches the end of the drain bed at which point it will reverse its flow and flow back through another passageway formed by the openings 16 and thus, the effluent will pass through the drain blocks four times all as disclosed in the aforementioned patent. In the aforementioned patent, the blocks 10 are individually installed in relation to each other by using conventional mortar so that each individual block is installed generally in the conventional manner of laying concrete blocks and the like.

Figure 2:
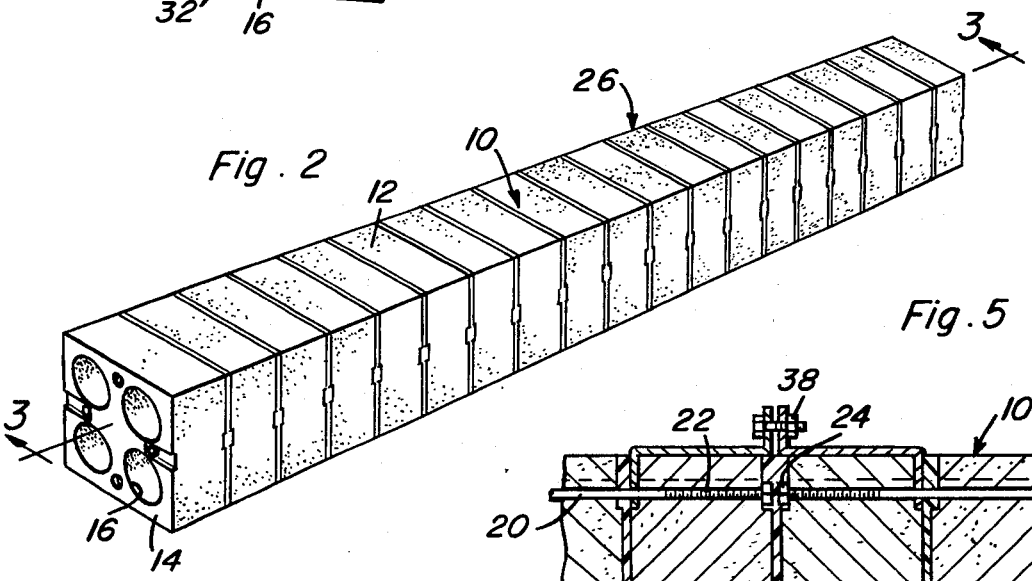
FIG. 2 is a perspective view of the concrete block assembly or module in which a plurality of blocks illustrated in FIG. 1 are retained in assembled, end-to-end, sealed, aligned relation by tension rods.

In the present invention, each concrete block is provided with four small apertures 18 extending from end-to-end through the block. These apertures 18, when aligned, receive tension rods 20 therethrough with the ends of the tension rods 20 having a threaded portion 22 receiving a retaining nut 24 thereon. Thus, by aligning a plurality of blocks 10 and inserting tension rods 22 therethrough and assembling clamp nuts 24 on the ends of the rods 22, a plurality of blocks 10 may be assembled into an assembly or module having a predetermined number of blocks with the assembly or module being illustrated in FIG. 2 and generally designated by numeral 26. Disposed between adjacent blocks 10 in the assembly 26 is a sealing material 28 in the form of a mastic of a waterproof type which maintains a degree of resilience and flexibility for a relatively long period of time. The mastic 28 is applied to the end of the block, and the blocks oriented in aligned relation and the tension rods assembled therewith and the clamp nuts assembled with the tension rods to form the assembly or module at a factory site, so that the assembly or module may be loaded onto a suitable truck, conveyed to the installation site and removed from the truck body and lowered into the drain field ditch by a suitable hoist which may be attached to the truck body or may be a separate piece of equipment. This procedure completely eliminates the necessity of a skilled block layer individually applying mortar to each block and assembling these blocks at the bottom of the ditch or trench and the tension rods prevent misalignment of the blocks and assure that they are all properly positioned and also retain such alignment even though the drain field may be subject to earth shifting or relatively heavy traffic, such as trucks or the like, at ground level.

Each end face 14 of each block 10 includes recesses 30 in the opposed edges thereof with the inner end of each recess 30 extending inwardly beyond the aperture 18. The other two apertures 18 in the block 10 have the terminal ends thereof surrounded by a recess or counterbore 32 so that retaining nuts 24 will be received in either the counterbore 32 or notch-type recess 30 with the end of the tension rods 20 and the nuts 24 terminating either inwardly or substantially flush with the end surface 14 of the block which forms the end block on the module 26. The purpose of the recess 30 is to receive a leg of a Z-shaped clip 34 which has oppositely extending apertured end flanges or end portions 36 with the apertures therein being of a size to receive the tension rod 20. The Z-shaped clips 34 are for the purpose of connecting two assemblies or modules 26 in end-to-end relationship as illustrated in FIGS. 4 and 5 with one of the apertured flanges 36 inserted into the recess 30 on the inner face of the endmost block 10 in the module as illustrated in FIG. 5 with the aperture being received on the tension rod 20. The other leg or flange of the clip 34 extends laterally outwardly in alignment with the outer face of the endmost block 10 in the module as illustrated in FIG. 5. Thus, by using two of the Z-shaped clips 34 in the manner illustrated in FIGS. 4 and 5 and by using a bolt assembly 38 to connect the outwardly projecting flanges or legs together two adjacent modules or assemblies 26 may be rigidly interconnected with each other and in alignment with each other with mastic 28 being disposed between the facing surfaces of the endmost blocks on the adjacent modules or assemblies. While each block is provided with recesses 30, such recess is used only when the connecting clips are used and the recesses on the inner face of the endmost block are the only ones used but this construction enables each of the blocks to be identically constructed thereby eliminating the necessity of having special end blocks. Also, the symmetrical location of the apertures 18 enables more rapid assembly of the blocks since the person assembling the blocks only has to locate the recesses 30 so that they are in the vertical side edges of the blocks when assembled. Thus, each block includes not only the recesses 30 in each face thereof but also the counterbores 32 in each face thereof. This enables the mastic to be machine placed on the blocks not only around the periphery thereof but also between the openings with the mastic filling the unused recesses 30 and counterbore 32 so that the blocks 10 are sealed in relation to each other and the large openings 16 are also sealed and isolated from each other. It is only necessary to use three tie rods 20 although four can be used if desired. The three tie rods provide adequate tensile force to maintain the blocks assembled. While fasteners 38 are in the form of bolts and nuts, other types of readily assembled fasteners may be used with it being pointed out that the flanges 36 project only slightly outwardly from the drain field thereby enabling assembly of the modules in the drain field trench. Each module may have a predetermined number of blocks therein and by varying the number of modules, the overall capacity of a drain field may be varied depending upon the installation or requirements. After the drain field has been prepared with appropriate ditches and a drain bed of gravel or the like if desired, the module or modules are installed and communicated with the septic tank system in a conventional and well known manner, so that one of the passageways formed by the aligned openings is in communication with the discharge of the septic tank system.

When installing the septic tank sewage disposal system, after the drain field trench or trenches have been formed with the bottoms thereof being substantially level, if only a single module of blocks is necessary, the module may be either lowered into the trench and connected to the septic tank and provided with appropriate elbows at each end interconnecting the passageways or an appropriate end block at each end which connects the passageways. If multiple modules are necessary, a mastic is placed on the end of one module and two Z shaped clips utilized to connect the modules together. This not only enables the individual blocks in the module to be more readily assembled at the factory site but also facilitates connection of multiple modules together at the installation site, thus materially reducing the labor and time required in installing the drain field in a septic tank sewage disposal system and providing a drain field which will be much more stable even though lateral pressures may be exerted when backfilling the trenches with loose soil or the like and even though pressures may be exerted thereon by truck traffic or the like traversing the ground surface thereby providing a longer lasting and more effective drain field which is less subject to clogging and also less subject to inefficient operation due to misalignment or separation of the blocks which sometimes occurs due to the deterioration of the motor joints between adjacent blocks.

The blocks 10 are constructed with a lightweight aggregate which differs from regular concrete in that the weight of the blocks is substantially reduced and the porosity is materially increased. The lightweight aggregate is in the form of shale rapidly heated to a high temperature and, in effect, exploded which forms small capillary passageways therethrough which occur throughout the completed block thus increasing the porosity of the block.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A concrete block drain line forming a drain field of a septic tank sewage disposal system comprising a plurality of identical porous concrete blocks oriented in end-to-end aligned and sealed relation, each block including a plurality of larger openings extending therethrough to form a plurality of longitudinal passageways for effluent flow and adapted to be interconnected at their ends, and tension means extending through small openings in the plurality of blocks for retaining the blocks in assembled sealed relation prior to installation in the drain field, said small openings being disposed symmetrically about the center of the blocks and between said large openings and adjacent the periphery of the block, said tension means being in the form of a plurality of tension rods extending through the small openings in each block with retaining nuts on each end of each rod, the ends of the rod and retaining nuts being received in recesses in the endmost blocks to enable adjacent, aligned assemblies to be disposed in adjacent relation for interconnection, said blocks being of square configuration with the large openings therethrough and small openings therethrough being symmetrically arranged to align the openings in different positions of the blocks relative to each other, said concrete block drain line being in the form of a module to be oriented in end-to-end, aligned relation to similar modules to form a drain field, and connecting means associated with the endmost blocks on said concrete block module, said connecting means including a recess in opposite side edges of the axially innerface of the endmost blocks of the concrete block module and retaining clips each having a portion received in the recess and on the tension rod and a portion extending laterally beyond the concrete block module with the projecting portion adapted to receive clamping bolts for securing the adjacent endmost blocks of two aligned concrete block modules in secure connected relation, each of said blocks in the concrete block drain line including recesses in both faces thereof to enable any of the blocks to be oriented as the endmost blocks and with either face of such blocks faced axially inwardly of the concrete block module.

2. The structure as defined in claim 1 wherein each of said clips is Z-shaped and includes an inwardly extending leg inserted between the endmost adjacent blocks in each module and an outwardly projecting leg generally in alignment with the end face of each module, said clamping bolts extending between the outwardly extending legs for connecting them together and retaining the modules in aligned position.

* * * * *